United States Patent [19]

Su

[11] Patent Number: 4,677,700

[45] Date of Patent: Jul. 7, 1987

[54] LAVATORY HOSPITAL BED

[76] Inventor: Cheng-Chung Su, No. 26, Shin Chong Road, Tainan, Taiwan

[21] Appl. No.: 837,787

[22] Filed: Mar. 10, 1986

[51] Int. Cl.[4] ..... A61G 7/02

[52] U.S. Cl. ..... 5/90; 5/463; 4/420.4; 4/455

[58] Field of Search ..... 5/90, 463; 4/300.2, 4/453, 455, 456, 457, 420.1, 450, 420.4, 420.5, 420.2, 420.3, 300.3, 443, 448

[56] References Cited

U.S. PATENT DOCUMENTS

| | | | |
|---|---|---|---|
| 520,929 | 6/1894 | Kraut | 5/463 |
| 719,811 | 2/1903 | Kent | 4/450 |
| 1,037,995 | 9/1912 | Ross | 5/90 |
| 1,525,605 | 2/1925 | Dry | 5/90 |
| 2,218,572 | 10/1940 | Dry | 5/90 |
| 3,419,920 | 1/1969 | Maddux, Jr. et al. | 5/463 |
| 3,757,355 | 9/1973 | Allen et al. | 5/90 |
| 3,922,735 | 12/1975 | Kato | 5/90 |
| 3,943,583 | 3/1976 | Ishikawa | 5/90 |
| 3,965,501 | 6/1976 | Bucher | 5/90 |
| 4,016,005 | 4/1977 | DiMatteo | 5/90 |

FOREIGN PATENT DOCUMENTS

| | | | |
|---|---|---|---|
| 264458 | 6/1927 | United Kingdom | 5/463 |

*Primary Examiner*—Thomas J. Holko
*Assistant Examiner*—Carl M. DeFranco, Jr.
*Attorney, Agent, or Firm*—Browdy and Neimark

[57] ABSTRACT

A hospital bed with a built-in toilet to be used in conjunction with disposable sanitary diaper funnels which comprises a mattress with a recess in its center portion, a ring shaped comfort cushion for sitting on while using the bathroom which fits into the recess, pipes for channeling wastes into a waste container, a water line which carries heated water from a tank to a spray nozzle which automatically cleans the anal area after defecation, an air dryer for drying the anal area after cleaning, a power switch for turning the dryer on and off, and a power switch for turning the water on and off.

2 Claims, 4 Drawing Figures

LAVATORY HOSPITAL BED

BACKGROUND OF THE INVENTION

This invention relates to a hospital bed for invalids who can not get up on their own to use the bathroom or who can not control when they go to the bathroom. Previously, there was no way of easily caring for these patients and their beds constantly had to be changed. As this is inconvenient and messy, a need arised to provide a sanitary means of using the bathroom while still in bed.

SUMMARY

A primary objective of this invention is to provide a sanitary means of using the bathroom while in bed.

Another objective of this invention is to provide a bed which can optionally be used as a normal hospital bed.

Further objectives and advantages of the present invention will become apparent as the following description proceeds, and the features of novelty which characterize the invention be pointed out with particularity in the claims annexed to and forming a part of this invention.

DETAILED DESCRIPTION OF THE PREFERRED EMBODIMENT

Figure 1:
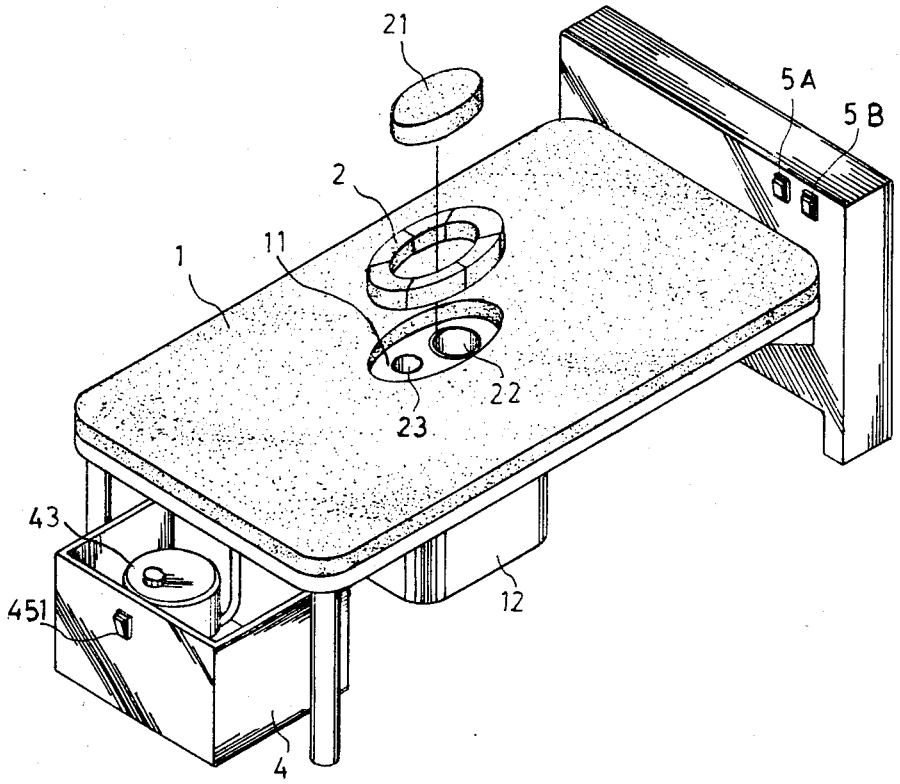
FIG. 1 is a perspective view of the bed of the present invention, with the comfort cushion shown in exploded form for clarity purposes.

Referring to FIG. 1, it can be seen that the present lavatory bed has a mattress 1 in the middle of which is a recess 11. Into the recess fits a comfort ring 2 and an insert 21. In normal usage, the insert 21 is placed into the comfort cushion 2 and the bed is used as a normal bed. But if a patient is unable to get to the bathroom without assistance or is unable to get out of bed due to medical restrictions, then the insert 21 may be removed and the patient may use the bathroom whenever he needs to without leaving his bed. This invention is especially useful in the situation where the patient is unable to control when he uses the bathroom. For sanitation purposes, sanitary diaper funnels 3 and 3' (see FIGS. 3 and 4), should be used in conjuction with the lavatory bed.

The sanitary diaper funnels 3 and 3' are similar to conventional disposable diapers, with the inside being padded for comfort with some absorbent material, the outside being a waterproof lining. The major difference is that the sanitary diaper funnels 3 and 3' of this invention have a scoop-like shape with a funnel shaped waste disposal tube 31. The scoop shape prevents the waste products from directly touching the patient, since the sanitary diaper funnels 3 and 3' drop down into the recess 11 shown in FIG. 1. Because the scoop slopes down into the funnel shaped waste disposal tube 31 the waste products fall easily from the diaper funnel into the funnel shaped waste disposal tube 31.

Figure 2:
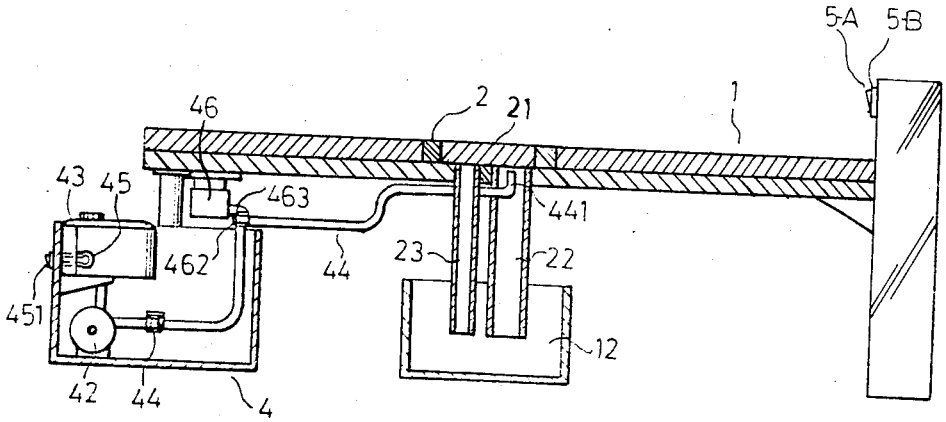
FIG. 2 is a cross-sectional view of the bed of the present invention.
Figure 3:
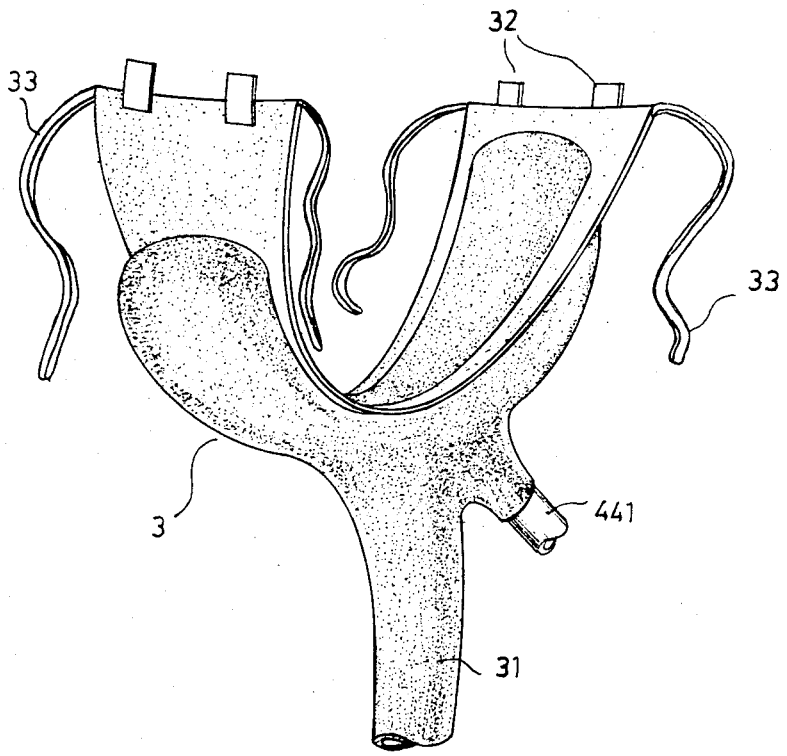
FIG. 3 is a view of the disposable diaper funnel of the present invention for females.
Figure 4:
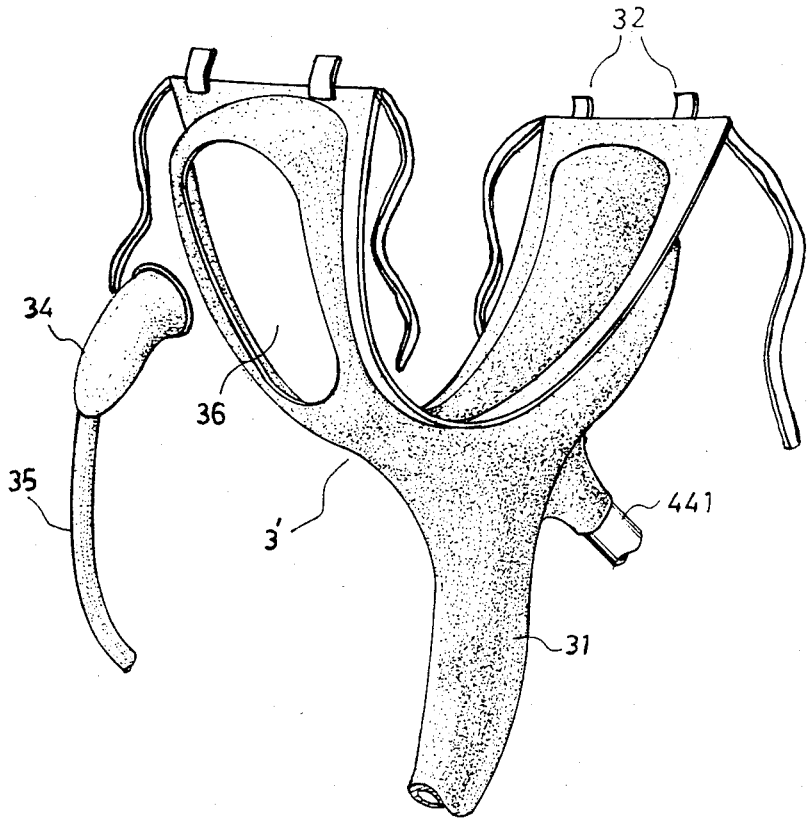
FIG. 4 is a view of the disposal diaper funnel of the present invention for males.

Referring FIG. 2, it can be understood that the funnel shaped waste disposal tube 31 shown in FIG. 3 and 4 may be funneled into the B.M. disposal tube 22, with of course the insert 21 removed. The B.M. disposal tube 22, in turn, directs the waste products into a neutralization tank 12. This neutralization tank 12 contains chemicals which destroy any bacteria which may be in the waste and which also neutralize the odor of the wastes. It should also be noted that the only difference between the male diaper funnel 3' and the female diaper funnel 3 is that the male diaper funnel 3' has a hole 36 through which the penis fits. Because this is the only difference, the two diaper funnels 3 and 3' could be manufactured as a single type of diaper funnel, the only difference being a hole stamped in the male diaper funnel 3'. This would prevent needless reproduction of production facilities.

Male patients must also use a urinary sheath 34 as shown in FIG. 4. The urinary sheath 34 is made of an elastic material formed in the shape of a penis. There is adhesive on the open end of the urinary sheath 34 which helps to keep it on. A urine disposal tube 35 connects with the end of the urinary sheath 34 which corresponds to the opening on the end of the penis. The other end of this urine disposal tube 35 is placed into the urine disposal pipe 23. This prevents defecation from getting on the urine disposal tube 35 which in turn makes replacing the urine disposal tube 35 more sanitary.

Referring to FIGS. 3 and 4, it can be seen that a spray nozzle 441 fits into an aperture which extends from the side of the waste disposal tube 31.

As can be seen in FIG. 2, the spray nozzle 441 extends upwards and faces in the direction of the anus of the patient. However, the nozzle 441 is slightly recessed from the B.M. disposal tube 31 so as not to be easily clogged up with defecation. After defecating, the patient may press the power switch 5-A on the head of the bed. This switch turns on the water pump 42 which in turn pumps warm water through the water pipe 44 to the spray nozzle 441 and which opens the solenoid valve 462. The water has been pre-heated to a prescribed temperature in a water tank 43 by a heating element 45. The temperature can be set by a temperature control knob 451 on the outside of the containment vessel 4. The spray nozzle 441 sprays water onto the patients anus, thereby cleaning it. The patient may then press switch 5-B which turns on an air dryer 46, and which also closes the solenoid valve 462 from the water line 44 to the water pump 42 and opens it from the air line 463 to the nozzle 441. The air from the air dryer 46 forces the water that is left in the water line 44 out through the spray nozzle 441. Then the air dryer 46 may be left on until the anus is dry.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

What is claimed is:

1. An improved lavatory hospital bed system comprising the combination of:

a mattress with a recess and a removable cushioned insert fitting therein, diaper funnels adapted for the sex of the patient which have a fitting for a spray nozzle for cleaning the patient after usage of said diaper, fluid piping which leads to said spray nozzle, and further characterized in that:

said spray nozzle is activated for either water or air by on/off switches on said lavatory hospital bed;

said diaper funnels having a scoop-like shape which does not directly contact the patient but which hangs down into the recess and which funnels wastes into a disposal pipe;

a disposal pipe, a urine disposal pipe, a neutralization tank containing sterilizing chemicals, an air dryer, a water pump, and piping which leads from a solenoid valve to a spray nozzle.

2. The hospital bed system of claim 1 wherein the diaper funnel for a male has a hole stamped through one side for insertion of the penis of the patient, and including a urine disposal pipe which may be placed into said urine disposal tube.

* * * * *